US012460412B2

(12) United States Patent
Rodrigues de Oliveira

(10) Patent No.: US 12,460,412 B2
(45) Date of Patent: Nov. 4, 2025

(54) REINFORCED CONCRETE MONOCOQUE ROOF CONSTRUCTION METHOD

(71) Applicant: José Gilberto Rodrigues de Oliveira, Saint-Barthelemy (FR)

(72) Inventor: José Gilberto Rodrigues de Oliveira, Saint-Barthelemy (FR)

(73) Assignee: José Gilberto Rodrigues de Oliveira, Saint-Barthelemy (FR)

( * ) Notice: Subject to any disclaimer, the term of this patent is extended or adjusted under 35 U.S.C. 154(b) by 133 days.

(21) Appl. No.: 18/044,051

(22) PCT Filed: Sep. 9, 2021

(86) PCT No.: PCT/EP2021/074739
§ 371 (c)(1),
(2) Date: Mar. 3, 2023

(87) PCT Pub. No.: WO2022/053534
PCT Pub. Date: Mar. 17, 2022

(65) Prior Publication Data

US 2023/0407632 A1 Dec. 21, 2023

(30) Foreign Application Priority Data

Sep. 9, 2020 (FR) ..... 2009133

(51) Int. Cl.
*E04B 7/04* (2006.01)
*E04G 11/48* (2006.01)
*E04G 25/04* (2006.01)

(52) U.S. Cl.
CPC ..... *E04B 7/04* (2013.01); *E04G 11/48* (2013.01); *E04G 25/04* (2013.01)

(58) Field of Classification Search
CPC ..... E04B 7/04; E04G 11/48; E04G 25/04
See application file for complete search history.

(56) References Cited

U.S. PATENT DOCUMENTS 8,776,468 B2 * 7/2014 Henriquez ..... E04B 5/263 52/481.1
10,196,818 B1 * 2/2019 Martell ..... E04C 5/0631
(Continued)

FOREIGN PATENT DOCUMENTS

FR 2175546 A1 10/1973
KR 20030029568 A 4/2003

OTHER PUBLICATIONS

Search Report from the French Intellectual Property Office on corresponding FR application (FR2009133) dated Apr. 20, 2021.
(Continued)

*Primary Examiner* — Andrew J Triggs
(74) *Attorney, Agent, or Firm* — Alumen IP Law PC

(57) ABSTRACT

The invention relates to a method for constructing a roof, the roof being intended for a building having a perimeter enclosure, the method having the production of a formwork configured to support the roof during its construction and to allow the casting of a slab, the construction of a supporting structure configured to ensure that the roof is mechanically resistant and that the roof is attached to the building receiving the roof, the casting of the slab performing a bonding material function, the slab being configured to transfer mechanical stresses within the supporting structure, and the construction of an external girdling, referred to as a cornice, connecting the roof to the building by girdling both a portion of an outer surface of the perimeter enclosure of the building and a portion of the girdling structure attached to the building, in order to increase the mechanical resistance of the roof to being torn off.

8 Claims, 2 Drawing Sheets

(56) References Cited

U.S. PATENT DOCUMENTS

| | | | | |
|---|---|---|---|---|
| 11,390,561 | B2 * | 7/2022 | Chun | C04B 20/1029 |
| 2008/0066395 | A1 * | 3/2008 | Aranda | E04B 7/02 52/745.06 |
| 2011/0036046 | A1 | 2/2011 | Henriquez | |
| 2023/0407632 | A1 * | 12/2023 | Rodrigues de Oliveira | E04B 7/04 |

OTHER PUBLICATIONS

International Search Report and Written Opinion on corresponding PCT application (PCT/EP2021/074739) from International Searching Authority (EPO) dated Nov. 5, 2021.

* cited by examiner

[Fig. 1]
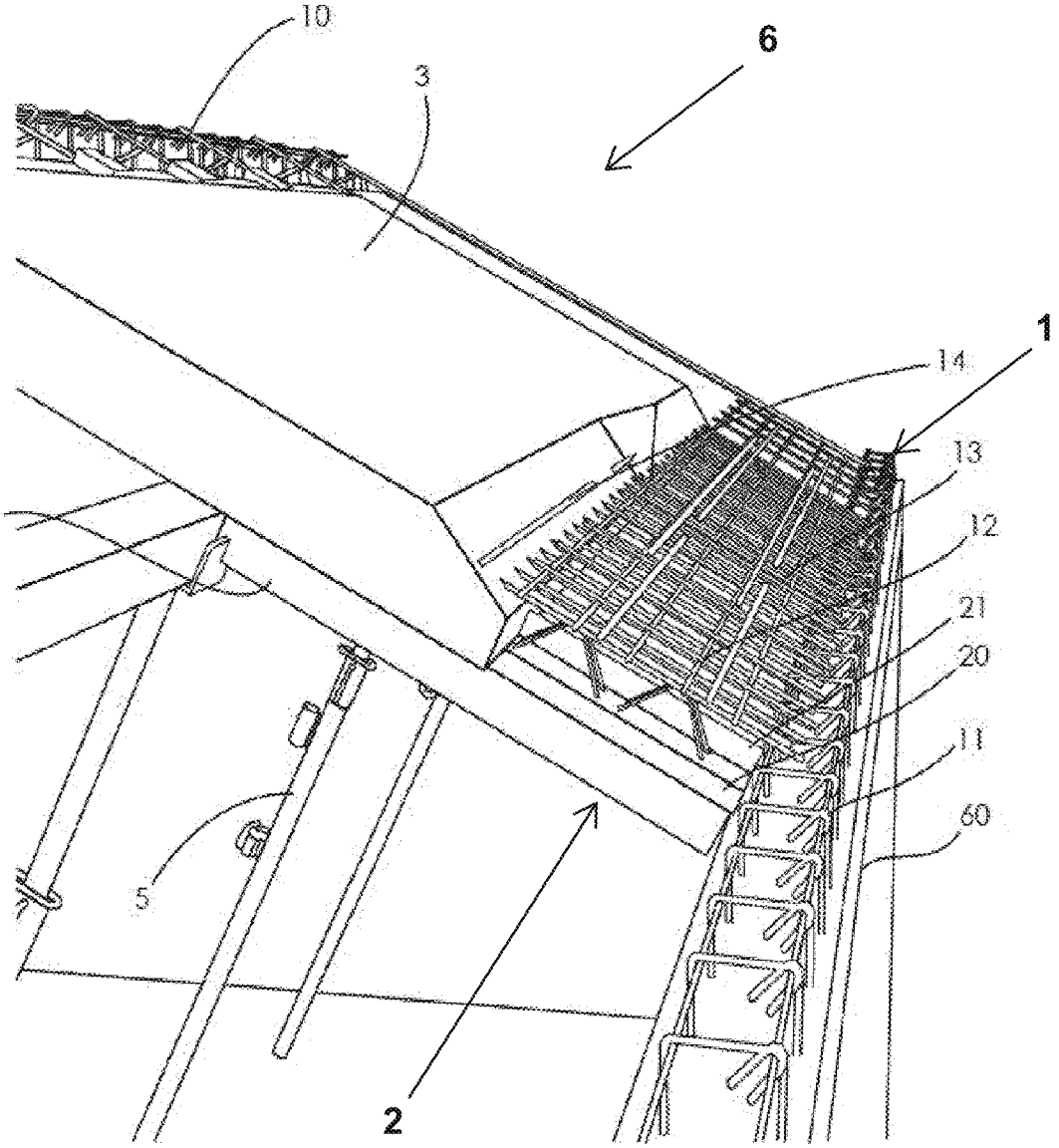

[Fig. 2]
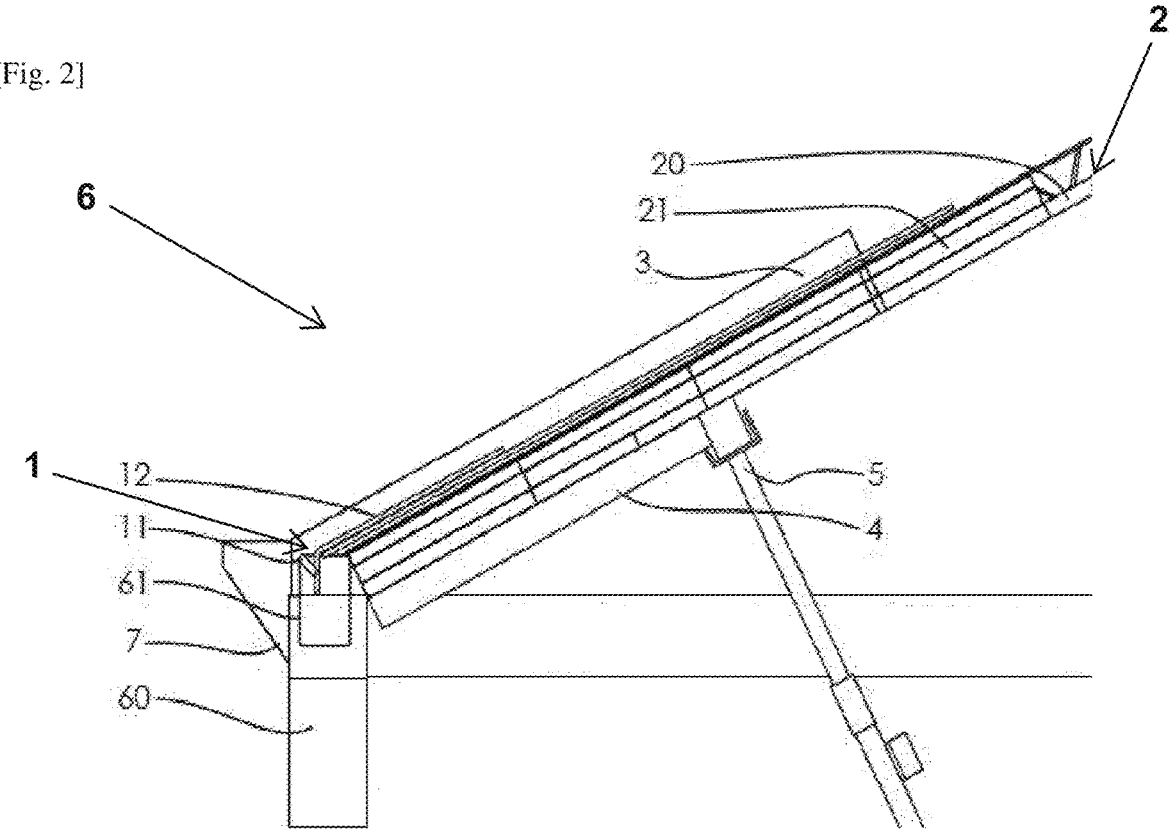
[Fig. 3]
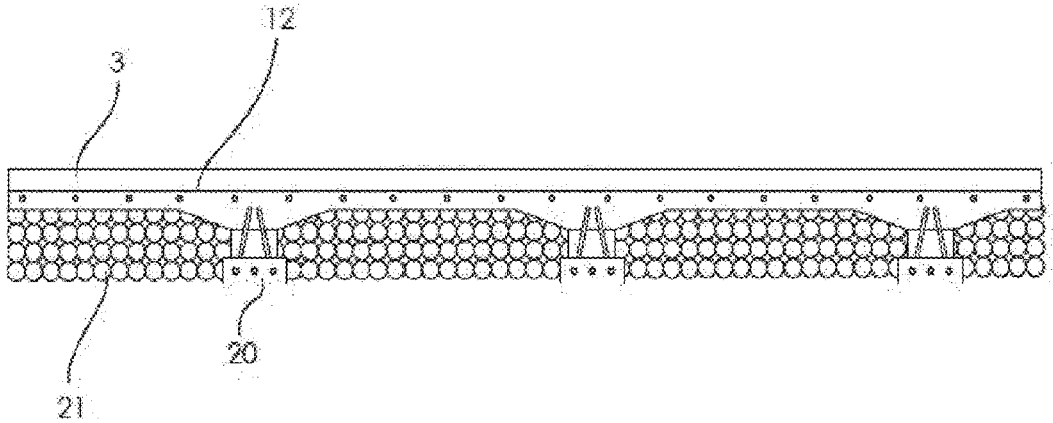

REINFORCED CONCRETE MONOCOQUE ROOF CONSTRUCTION METHOD

TECHNICAL FIELD

The present invention relates to the field of building roof construction. More precisely, the invention is directed to a method for constructing a roof having improved strength, especially in the event of violent mechanical strains due to a hurricane and/or an earthquake.

In a known manner, conventional roofs are made of a framework, a frame which mainly provides the strength of the roof, and of a roof covering, which ensures sealing of the roof.

However, in regions exposed to cyclonic phenomena, buildings are regularly subjected to the force of violent winds as well as impacts from objects transported by the wind which may lead to roof tearing or degradation. In areas exposed to seismic risks, buildings are subjected to seismic shocks which may lead to roof collapse or degradation by shearing. It is therefore desirable to construct mechanically stronger roofs, especially likely to resist tearing in the event of violent winds and not to collapse in the event of an earthquake.

Within this context, document FR 3076310 A1 describes a method for constructing a roof designed to resist violent winds, said roof consisting of concrete plates attached to principal rafters, corresponding to framework elements, and to cross members, by means of bolts, the principal rafters being themselves fitted to a cross purlin and plate beam. This construction method using concrete plates enables increased strength of the roof. One drawback of the roof described in document FR 3076310 A1 lies in the fact that the roof comprises two assembled parts, the framework and the roof, likely to disengage under high mechanical strains.

The invention aims to overcome at least partly this type of drawback and consequently to improve the strength of a roof as well as the mechanical connection between said roof and the building, in particular with respect to tearing or shear stresses, or in the event of an impact caused by an object falling on said roof.

For this purpose, the present invention is directed to a method for constructing a so-called monocoque roof, in other words, constructed in a single block rigidly connected to the building.

SUMMARY

More precisely, the invention relates to a method for constructing a roof, the roof being configured to a building having a rigid peripheral enclosure, the method comprising making a formwork configured to support the roof while it is made and allow a slab to be poured, making a bearing frame configured to ensure mechanical strength of the roof and the attachment of the roof to the building accommodating the roof, pouring the slab ensuring a function of binder material, said slab being configured to transfer mechanical loads within the bearing frame, and making an external girdling, in other words a cornice, connecting the roof to the building by girdling both a portion of an external face of the peripheral enclosure of the building and a portion of the bearing frame attached to the building, to increase the tearing strength of said roof.

By means of the invention, a roof according to the invention has improved strength, as well as an improved mechanical connection between said roof and the building, in particular with respect to tearing or shear stresses, or in the event of an impact caused by an object falling on said roof. Moreover, the invention allows the prefabrication of certain components of the roof according to the invention, thereby reducing the time for constructing a roof according to the invention.

Advantageously, making the bearing framework comprises making a main frame, comprising a set of metal or synthetic reinforcements, configured to ensure spatial delimitation of the roof and the securement of the roof to the building and to enhance the mechanical strength of the roof, and making a secondary frame, comprising a plurality of floor bearing elements and a plurality of spacer elements, said secondary frame being configured to increase strength of the main frame and to receive the slab.

Advantageously, making the main framework comprises placing wall tie reinforcements on a peripheral portion of the roof, to ensure spatial delimitation of the roof and the securement of the roof with synthetic or metal reinforcements protruding from the building, such as reinforcements protruding from posts or beams or shells or wall ties; placing complementary reinforcements formed of welded meshes on the entire roof, to ensure a load distribution in the slab; placing edge continuity reinforcements to ensure load transmission to said wall tie reinforcements of the roof; and placing continuity reinforcements to ensure load transmission in the secondary frame.

Advantageously, making the secondary frame comprises placing the bearing elements of a concrete floor, referred to as floor beams, configured to bear on the main frame and on the building; and placing the spacer elements, referred to as interjoists, configured to space apart and heel the bearing elements.

According to one embodiment, the interjoists consist of a thermal insulating material.

According to one embodiment, the interjoists consist of a thermal insulating material, for example extruded polystyrene.

According to one embodiment, making the slab consists in pouring a reinforced concrete slab as one-piece over the entire roof.

According to one embodiment, the reinforced concrete slab consists of a reinforced concrete slab of the metal or synthetic fiber type comprising sealing anti-crack admixtures.

According to one embodiment, the invention further comprises laying a roof covering on the assembly formed by the bearing frame and the slab to enhance sealing and ensure esthetics of the roof.

BRIEF DESCRIPTION OF THE DRAWINGS

The invention will be better understood upon reading the following description, given as an example, and referring to the following figures, given as non-limiting examples, in which identical references are given to similar objects.

FIG. 1 is a schematic representation of the building and the general roof components.

FIG. 2 is a schematic representation of a cross-section view of the building and the roof, with in particular the representation of the attachment of the main bearing frame to the building.

FIG. 3 is a schematic representation of a cross-section view of the roof according to the invention.

It should be noted that the figures set out the invention in detail in order to implement the invention, said figures can of course be used to better define the invention if necessary.

DETAILED DESCRIPTION

With reference to [FIG. 1], the invention relates to a method for constructing a so-called monocoque roof, in other words constructed in a single block so as to be rigidly connected to the building, comprising making a formwork 4 to support the roof while it is made; a bearing frame 1-2 to ensure strength of the roof and the rigid attachment of the roof to the building 6; a slab 3 to ensure transfer of mechanical loads to the bearing frame and an external girdling 7 to improve the tearing strength of the roof.

Making the formwork 4 comprises installing wood panels possibly held in place using struts 5, in other words temporary retaining elements. The struts are used to reinforce the formwork for the step of pouring the slab 3.

Making the bearing frame comprises making a main frame 1 and a secondary frame 2. The main frame 1, consisting of metal or synthetic reinforcements, ensures part of the strength of the roof and the attachment of the roof to the building. The secondary frame, comprising especially floor bearing elements, called floor beams 20, and spacer elements, called interjoists 21, contributes to enhancing the strength of the roof and enables the slab 3 to be accommodated.

Making the main frame comprises the following successive steps.

Firstly, positioning and attaching reinforcements of the wall tie reinforcement 10-11 type is carried out on a peripheral portion of the roof. Wall tie reinforcements 10-11 are connected either to each other, to ensure strength of the roof, or to metal or synthetic reinforcements protruding from the building, especially reinforcements protruding from the posts or beams or shells or wall ties 11 of the building, so as to ensure attachment of the frame to the building. Wall tie reinforcements are attached, especially by welding or by a splicing method.

Secondly, positioning complementary reinforcements of the welded mesh 12 type above the secondary frame 2 and attaching said welded meshes 12 to the wall tie reinforcements 10-11 is carried out, to form a reinforcement of the distribution slab so as to ensure load distribution on the floor beams 20.

Positioning and attaching reinforcements of the edge reinforcement 13 type which are anchored to the wall tie reinforcements 10 and 11 is then carried out, so as to ensure load transmission to said wall tie reinforcements 10-11 of the roof. These edge reinforcements 13 can be positioned at the same time, before or after the continuity reinforcements 14 described below.

Positioning and attaching reinforcements of the continuity reinforcement 14 type, transversely to the orientation of the floor beams 20 and above them, is also carried out so as to ensure transmission of the mechanical loads between the floor beams 20. These continuity reinforcements 14, as said previously, can be positioned at the same time, before or after the edge reinforcements 13.

The constituent materials of the reinforcements 10-11-12-13-14 consist of steel or synthetic fibers. The cross-sections of the reinforcements 10-11-12-13-14 and their respective arrangements in the roof depend especially on the dimensions of the roof.

With reference to [FIG. 3], making the secondary frame 2 comprises making and positioning the floor beams 20, and the interjoists 21. The secondary frame 2 is configured so that the floor beams 20 and the interjoists 21 rest on building 6 and especially on a peripheral enclosure, in other words front and interior bearing walls, edge beams and internal beams.

The floor beams 20 are placed on the formwork 4 after laying the wall tie reinforcements 10 and before laying the welded meshes 12, the edge reinforcements 13 and the continuity reinforcements 14. Preferably, the floor beams 20 are spaced apart between each other by a center distance not exceeding 750 mm. The floor beams 20 can be temporarily supported by struts 5 during the roof construction phase. The floor beams 20 have a transverse cross-section consisting of reinforced concrete, in particular metal or synthetic fiber reinforced concrete, or prestressed concrete and are fully or partially prefabricated. In the case of a reinforced concrete floor beam, the longitudinal reinforcement of said floor beams 20 is made of steel for reinforced concrete. The floor beams 20 can also be formed of triangulated wire mesh. The common span for such floor beams 10 is 7 m.

The interjoists 21 are made so as to have adapted geometric dimensions to enable them to be snap fitted into the heels of the floor beams 20, said heels preferably having a thickness of 120 mm and a width of 500 mm. The interjoists 21 are positioned between the floor beams 20 so that they are clamped to the heels of the floor beams 20 to ensure spacing of the floor beams 20. The interjoists 21, whether or not able to withstand a mechanical load according to their constituent material, preferably consist of a material complying with European standards series NF EN 15037-2 to 5, and may consist in particular of extruded polystyrene with a density of between 20 and 50 kg/m$^3$, referred to as high density polystyrene, to ensure a thermal insulation function.

Making the slab 3 consists in pouring the slab 3, called a distribution slab, consisting of a binder material, in other words a material ensuring cohesion and mechanical adhesion between the slab 3 and the bearing frame 1 and 2, as one-piece and on site over the entire bearing frame of the roof so as to fill and cover it. The material used for the slab 3 preferably consists of reinforced concrete of the metal or synthetic fiber type optionally supplemented with anti-crack sealing admixtures, in particular superplasticizing admixtures, otherwise referred to as high water reducing admixtures, having a content of between 0.6 and 2.5% of the mass of the reinforced concrete. The thickness of the slab 3 is preferably equal to 7 cm.

With reference to [FIG. 2], making the outer girdling 7 comprises laying a cornice, consisting of prefabricated reinforced concrete and having protruding reinforcements, configured to girdle both a portion of an external face of the peripheral enclosure of the building and a portion of the bearing frame 1-2 attached to the building by connecting the reinforcements of said cornice to the reinforcements of the bearing frame of the roof and the building 6, respectively, to enhance the tearing strength of the roof.

The method for constructing the roof, according to an embodiment, is completed by installing a roof covering to ensure sealing and improve the esthetics of the roof. There are no particular restrictions on the choice of type of roof covering.

The method for constructing the roof also optionally comprises a step of cladding the internal face of the roof, with especially a false ceiling or under-sloping walls.

The invention especially has the advantage that the roof thus constructed can be partially or fully prefabricated and assembled to the building or be made directly on the building The invention has the advantage of providing improved strength of such a roof as well as an improved mechanical connection between said roof and the building, in particular with respect to tearing or shear stresses, or in the event of an impact caused by an object falling on said roof.

The invention claimed is:

1. A method for constructing a roof, the roof being intended for a building having a rigid peripheral enclosure, the method comprising:

making a formwork configured to support the roof while it is made and to allow a slab to be poured, making a bearing frame configured to ensure mechanical strength of the roof and connect the roof to the building accommodating the roof, pouring the slab ensuring a function of binder material, said slab being configured to transfer mechanical loads within the bearing frame, making an external girdling, comprising a cornice, connecting the roof to the building by girdling both a portion of an external face of the peripheral enclosure of the building and a portion of the bearing frame attached to the building, to increase the tearing strength of said roof, wherein making the bearing frame comprises:

making a main frame, comprising a set of metal or synthetic reinforcements, configured to ensure spatial delimitation of the roof and connect the roof to the building and to enhance mechanical strength of the roof, making a secondary frame, said secondary frame being configured to increase the strength of the main frame and to receive the slab, and wherein the main frame comprises:

wall tie reinforcements connected to corresponding reinforcements extending out of a wall of the building to which the roof is connected; and a welded mesh connected to the wall tie reinforcements, the welded mesh located above the secondary frame; and the secondary frame comprises:

floor beams located underneath the wall tie reinforcements and the welded mesh, the floor beams being configured to rest on the wall of the building and be temporarily supported by respective struts during a construction phase of the roof; and spacer elements located in between and snap-fitted to the floor beams.

2. The method for constructing a roof according to claim 1, wherein making the main frame comprises:

placing the wall tie reinforcements on a peripheral portion of the roof, to ensure spatial delimitation of the roof and connect the roof with metal or synthetic reinforcements protruding from the building, including reinforcements protruding from posts or beams or shells or wall ties;

placing complementary reinforcements formed of welded meshes on the entire roof, to ensure load distribution in the slab;

placing edge reinforcements to ensure load transmission to said wall tie reinforcements of the roof; and placing continuity reinforcements to ensure load transmission in the secondary frame.

3. The method for constructing a roof according to claim 1, wherein making the secondary frame, comprising a plurality of floor bearing elements and the spacer elements, comprises:

placing the plurality of floor bearing elements of a concrete floor, each floor bearing element defining a floor beam, configured to bear on the main frame and on the building; and placing the spacer elements, each spacer element defining an interjoist, configured to space apart and secure the plurality of floor bearing elements.

4. The method for constructing a roof according to claim 3, wherein each interjoist consists of a thermal insulating material.

5. The method for constructing a roof according to claim 4, wherein the thermal insulating material consists of an extruded polystyrene material.

6. The method for constructing a roof according to claim 1, wherein making the slab includes pouring a reinforced concrete slab as one-piece over the entire roof.

7. The method for constructing a roof according to claim 1, wherein the slab comprises a reinforced concrete slab of the metal or synthetic fiber type and the slab further comprises sealing anti-crack admixtures.

8. The method for constructing a roof according to claim 1, further comprising laying a roof covering on the bearing frame and the slab to enhance sealing and ensure esthetics of the roof.

* * * * *